US008910771B2

(12) United States Patent
Robinson et al.

(10) Patent No.: US 8,910,771 B2
(45) Date of Patent: Dec. 16, 2014

(54) BILLS AND/OR CARD VALIDATOR AND STORAGE APPARATUS

(75) Inventors: Chris Robinson, Oldham (GB); Peter Dunlop, Oldham (GB)

(73) Assignee: Innovative Technology Limited, Oldham (GB)

( * ) Notice: Subject to any disclaimer, the term of this patent is extended or adjusted under 35 U.S.C. 154(b) by 679 days.

(21) Appl. No.: 12/144,714

(22) Filed: Jun. 24, 2008

(65) Prior Publication Data

US 2009/0008857 A1 Jan. 8, 2009

(30) Foreign Application Priority Data

Jun. 26, 2007 (GB) ..... 0712374.8

(51) Int. Cl.
*G07D 7/00* (2006.01)
*G07D 11/00* (2006.01)

(52) U.S. Cl.
CPC ..... *G07D 11/0006* (2013.01); *G07D 11/018* (2013.01)
USPC ..... 194/203; 194/206; 194/207; 271/226; 271/248

(58) Field of Classification Search
CPC ..... G07D 5/00; G07D 5/08; G07F 9/06; G07F 1/04; G07F 5/24; G07F 1/043; G07F 1/044; G07F 7/04
USPC ..... 194/206, 207, 203, 202; 209/534; 382/135; 358/305; 271/226, 229, 230, 271/234, 245, 248
See application file for complete search history.

(56) References Cited

U.S. PATENT DOCUMENTS

| | | | | | |
|---|---|---|---|---|---|
| 5,005,688 | A * | 4/1991 | Yukimoto et al. | ..... | 194/206 |
| 5,208,445 | A * | 5/1993 | Nahar et al. | ..... | 235/375 |
| 5,547,061 | A * | 8/1996 | Itako et al. | ..... | 194/203 |
| 5,632,367 | A * | 5/1997 | Bergeron et al. | ..... | 194/207 |
| 5,806,649 | A * | 9/1998 | Walsh et al. | ..... | 194/203 |
| 5,907,141 | A * | 5/1999 | Deaville et al. | ..... | 235/375 |
| 5,988,345 | A * | 11/1999 | Bergeron et al. | ..... | 194/203 |
| 6,044,952 | A * | 4/2000 | Haggerty et al. | ..... | 194/207 |
| 6,877,599 | B2 * | 4/2005 | Pai | ..... | 194/203 |
| 7,014,189 | B2 * | 3/2006 | Liu et al. | ..... | 271/248 |
| 7,104,383 | B1 * | 9/2006 | Saltsov et al. | ..... | 194/206 |
| 2001/0030100 | A1 * | 10/2001 | Negishi | ..... | 194/302 |
| 2002/0036159 | A1 * | 3/2002 | Graef et al. | ..... | 209/534 |
| 2002/0092727 | A1 * | 7/2002 | Kato | ..... | 194/302 |
| 2004/0164147 | A1 * | 8/2004 | Jenkins et al. | ..... | 235/382 |
| 2004/0211644 | A1 * | 10/2004 | Liu et al. | ..... | 194/207 |
| 2004/0245708 | A1 * | 12/2004 | Takeuchi | ..... | 271/177 |
| 2005/0156025 | A1 * | 7/2005 | Utz | ..... | 235/379 |
| 2006/0163027 | A1 * | 7/2006 | Hobmeier et al. | ..... | 194/207 |
| 2009/0208088 | A1 * | 8/2009 | Saltsov et al. | ..... | 382/135 |

* cited by examiner

*Primary Examiner* — Jeffrey Shapiro
(74) *Attorney, Agent, or Firm* — Dinsmore & Shohl LLP

(57) ABSTRACT

The invention relates to apparatus for the provision of receipt, validation and collection of banknotes or tickets which are input by a user, typically as payment for a service which has or is to be provided. The apparatus allow for the accurate location of the banknote or ticket as it passes through the apparatus and the accurate validation of the same. In one embodiment a printer assembly is provided which allows the apparatus to print tickets and to pass the same in the reverse direction to input banknotes or tickets, to be provided to the user as, for example a credit which can be cashed subsequently by the user.

31 Claims, 12 Drawing Sheets

BILLS AND/OR CARD VALIDATOR AND STORAGE APPARATUS

BACKGROUND OF THE INVENTION

The invention to which this application relates is to apparatus of the type which can be used to receive bills or notes or cards, which typically have a monetary value in a particular currency. The apparatus can be required to firstly identify and check the validity of the bills or cards hereinafter referred to as bills in a non limiting manner) and then, if accepted, store the bills in a storage container in a secure manner.

Bill validator apparatus is well known and there are many patents which relate to specific features of this type of apparatus. A common problem experienced by all types of apparatus is to ensure that the bills are entered and stored in a secure manner within the apparatus so as to only be subsequently be removable in an authorised manner. A further problem is to ensure that the apparatus is as resistant as possible to unauthorised attempts to defraud the apparatus and a yet further problem is to provide the means and components required to meet the ever increasing customer demands within a physical space which cannot be increased.

The applicant has identified the need to provide an improved form of apparatus which has improvements in terms of security, ease of use for the customer and which is efficient and adaptable to specific customer requirements.

SUMMARY OF THE INVENTION

In a first aspect of the invention there is provided bill validation and/or storage apparatus, said apparatus including at least one bill infeed assembly including an aperture and bill feeding mechanism, and a storage container into which accepted bills can be passed for storage, said infeed assembly removably received and located on said storage container and wherein said infeed assembly is provided with a locking mechanism which serves to lock the same to the storage container.

Typically the locking mechanism is located so as to prevent the storage container from being separated from the infeed assembly and also to prevent the storage container from being removed from the housing surrounding the same in conjunction with which the storage container and infeed assembly are mounted.

In one embodiment the storage container is provided with a separate locking means which, when locked, serves to prevent access being gained to the interior of the storage container and any bills held therein.

In one embodiment a key or access code can be common to both the locking mechanism and locking means or alternatively the keys or access codes can differ so as to allow, for example, the locking mechanism to be released by a first person, to allow the storage container to be removed from the apparatus and the locking means is then released via a different key or access code by a second person and/or at a second location.

In a further aspect of the invention there is provided bill validation and/or storage apparatus, said apparatus including at least one bill infeed assembly including an aperture and bill infeed mechanism, said infeed mechanism including a path which is defined for an input bill to follow, wherein said mechanism includes at least one arm, said arm mounted to be movable in a defined manner, and a plurality of wheels to provide driven movement of the bill through the mechanism, said arm and wheels movable into and out of contact with the bill in the defined manner to provide a straightening action on the bill.

Typically the straightening action is performed at or adjacent to the location at which the bill initially enters the apparatus In one embodiment when the input of the bill is detected, the arm, typically two arms, are introduced to contact the bill from opposing elongate edges of the bill, said arms typically spring loaded and exert a straightening action so as to cause the longitudinal axis of the bill to lie substantially parallel with the axis along which the bill is to be moved by the infeed mechanism. The length of contact necessary between the arms and the bill can be determined so as to allow the required straightening effect to be achieved.

Typically the drive wheels follow the arms into contact with the bill to exert the movement force on the same. Preferably the wheels are moved into contact with the bill, prior to the arms being moved out of contact from the bill. This ensures that there is always a positive gripping force exerted on the bill.

In one embodiment the movement of the arms and/or wheels with respect to the bill is controlled by a cam movement means which causes advance and retraction movement of the arms and/or wheels.

In a preferred embodiment the drive which allows movement of the cam is derived from the same motor which is used to operate a bill stacker mechanism within the storage container to which the infeed assembly is attached.

In a further aspect of the invention there is provided bill validation and/or storage apparatus, said apparatus including at least one bill infeed assembly including an aperture and bill feeding mechanism, and a storage container into which accepted bills can be passed for storage, said infeed assembly located with said storage container and wherein said infeed assembly is provided with a further aperture located downstream of the infeed aperture, said input bill selectively passed to exit through the further aperture if the same does not meet predetermined criteria when assessed.

Typically the infeed assembly can be removably located with the storage container.

In one embodiment said further aperture is used to receive bills as an input and the infeed mechanism is reversed in direction so as to allow the bills input through the further aperture to be fed out of the apparatus through the infeed aperture.

In one embodiment the bills are in the form of tickets which have a value allocated to the same and which can be taken by a customer to allow a cash equivalent to be provided to them.

In one embodiment the value is allocated in response to a control signal from processing means connected to the apparatus and preferably is printed via a printer mounted adjacent to the further aperture prior to the ticket being moved into the infeed mechanism.

In one embodiment the ticket passes through a validation stage prior to reaching the infeed aperture.

Alternatively the further aperture is provided in connection with a supply of bills which in response to a specific signal received, may be paid out by passing the same from the further aperture to the infeed aperture as, for example, a cash prize payout to a customer who can collect the same from the infeed aperture.

In a yet further aspect of the invention there is provided bill storage apparatus, said apparatus including at least one storage container in which there is included a stacker mechanism and wherein said bills are stacked in a substantially vertical plane.

In one embodiment each bill as it enters the storage container, typically having been previously validated, is detected and the particular position of the same identified.

Typically a fingered wheel is provided to contact with the bill and then adjacent plates are moved so as to pass over respective longitudinal edges of the bill and cause the bill to start or join the stack of bills already in the container.

Typically the stack is mounted on a plate which is provided with resilient means connected thereto. However in the configuration of the current invention the force required to be exerted against the action of the resilient means to move the bill onto the stack is significantly reduced.

Typically the movement cycle of the stacker mechanism is driven by a motor connected thereto and the movement cycle is completed using one direction of rotation of the motor. The ability to complete the stacker cycle using only one direction of rotation of the motor means that the reverse direction of rotation is available to be used to drive the bill straightening arms and therefore the two inventive operations can be achieved using one motor.

In a yet further aspect of the invention there is provided bill validation and/or storage apparatus, said apparatus including at least one bill infeed assembly including an aperture and bill feeding mechanism, and a storage container into which accepted bills can be passed for storage, said apparatus including a lid which can be selectively opened to allow access and closed to allow the apparatus to act as a self contained unit wherein said lid is provided with resilient means which bias the lid to an open position unless the lid is correctly latched in the closed position.

In one embodiment the lid is provided with a self latching mechanism such that when the lid is brought to a closed location the self latching mechanism engages and secures the lid in position.

This aspect of the invention therefore ensures that if the lid is not in the closed position when it is desired for the same to be so, the lid will be biased to move to the open position and therefore provide an easily visible indication of the incorrect position of the lid.

In a further aspect of the invention there is provided bill validation and/or storage apparatus, said apparatus including at least one bill infeed assembly including an aperture and bill feeding mechanism and wherein there is provided as part of the infeed mechanism first and second sets of optical sensors, said first and second sensors spaced apart with respect to the path of movement of the bill along the infeed assembly.

Typically a first set of optical sensors are positioned at or adjacent to the infeed aperture to detect the entry of the bill and the second set of sensors are located downstream of the first set of sensors.

Typically the first and/or second sets of sensors can be used to detect the presence of strimming means such as wires or tapes attached to the notes which are attached to attempt to defraud the apparatus by subsequently withdrawing the note. Typically the first and second sets of sensors are used to determine respectively the start and stop points for the movement of the bill.

In one embodiment of the apparatus there is provided a sensor which allows the determination of the position of the cam for the control of the bill straightening mechanism to be checked to ensure that the same is in the correct position for the next bill.

In one embodiment a further sensor is provided to allow the detection of the correct location of the bill storage container to be made.

In one embodiment a further sensor is provided to allow the detection of the position of the stacker mechanism within the storage container to be detected.

In one embodiment a further sensor is provided to allow a detection to be made of when the storage container is full of bills.

In one embodiment of the invention the apparatus includes a data storage device reader thereby allowing an operator of the apparatus to update or change operating software or operating parameters by the introduction of, or replacing, a data storage means, into the data storage device reader. In one embodiment access is gained via a slot in the aperture, which slot may only be accessible by authorised personnel.

It should be appreciated that any combination of the aspects of the invention can be provided in a specific apparatus. Indeed it is preferred that apparatus is provided which utilises all of the aspects of the invention in combination.

BRIEF DESCRIPTION OF THE DRAWINGS

Specific embodiments of the invention are now described with reference to the accompanying drawings wherein.

DETAILED DESCRIPTION OF THE PREFERRED EMBODIMENTS

Figure 1B:
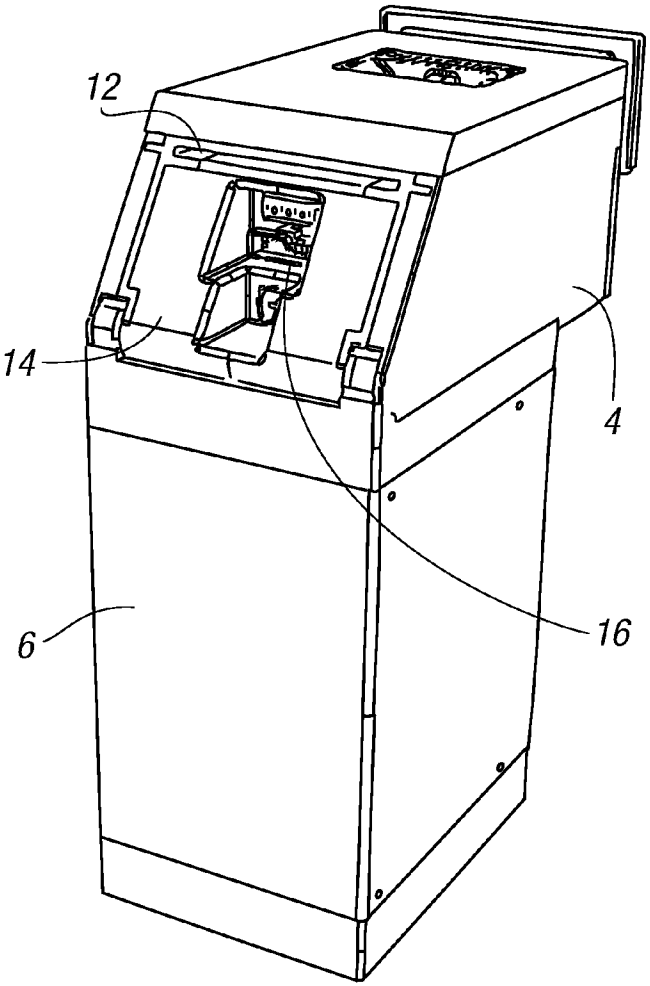
FIGS. 1*a-f* illustrate one embodiment of the combined infeed assembly and storage container in accordance with the invention.
Figure 1A:
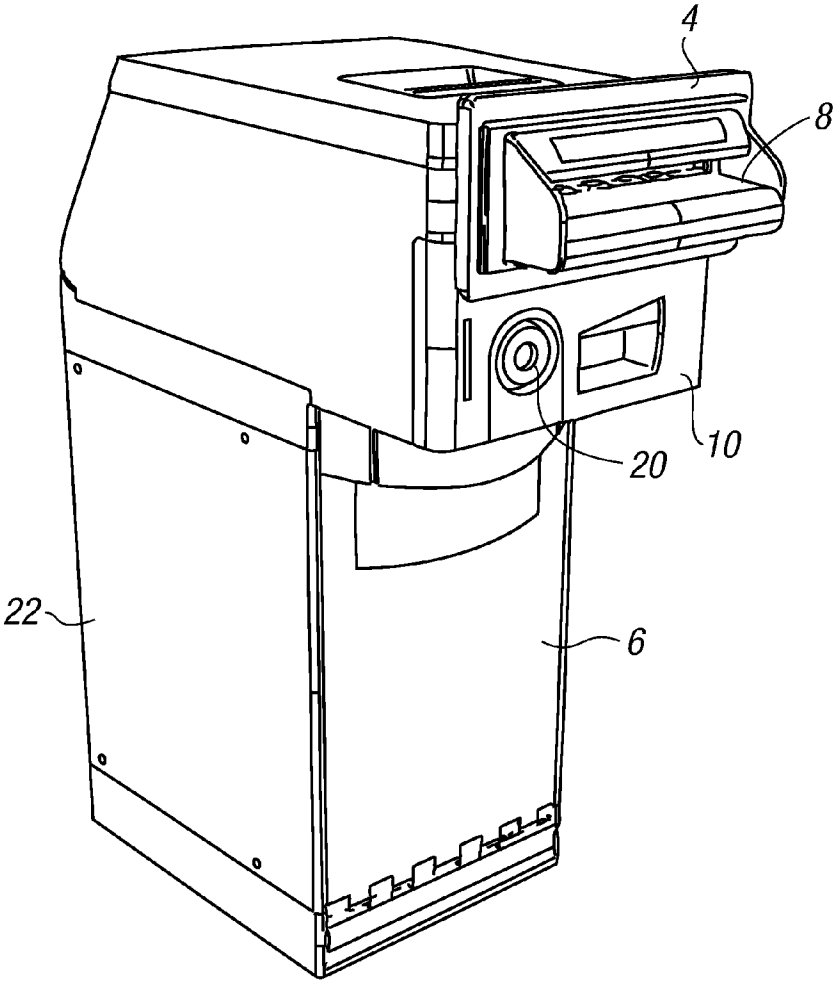
Figures 1C, 1D, 1E, 1F:
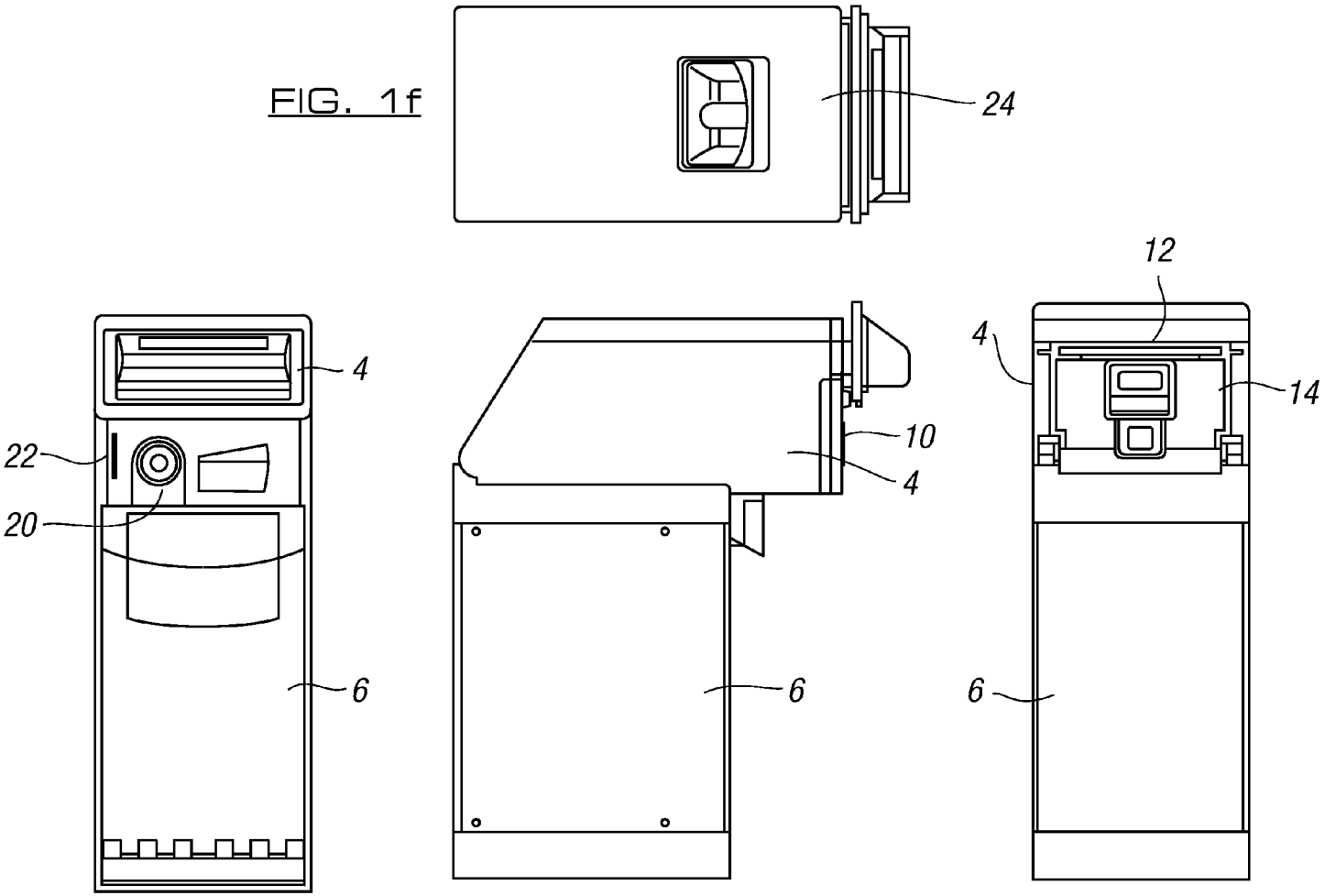

Referring firstly to FIGS. 1*a-f* there is illustrated apparatus 2 in accordance with one embodiment of the invention. The apparatus comprises an infeed assembly 4 and a storage container 6. It should be appreciated that this apparatus will typically be incorporated into a larger item of apparatus such as a casino based bill processing apparatus and therefore, to some extent the physical dimensions and shape of the apparatus is confined by the parameters of the larger item of apparatus.

The infeed assembly includes a note infeed aperture 8 at the front face 10 and a further aperture 12 at the rear face 14 and also at which can be provided data connection sockets 16 which allow the apparatus to be connected to control and processing means (not shown).

The infeed assembly also includes a locking mechanism 20 and a slot 22 for reception of a data carrying device.

The top 24 of the infeed assembly is provided as a lid which can be hingedly opened and closed as required by an operator. In accordance with this embodiment the lid is biased to an open position such that in order for the same to be closed properly a positive engagement has to be made between the lid and the housing.

In use a customer may wish to place a bill or note into the apparatus, typically to pay for a service or to be allocated credits, for example, credits which can be used to play a casino game. To do this they place the bill into the apparatus in a predetermined orientation into the aperture 8 of the infeed mechanism. The bill is then passed towards the rear of the assembly via an infeed mechanism, and during which the validity of the bill is determined by conventional detection means. If the bill is determined as being valid the monetary value is allocated and the bill itself is passed down and into the storage container to be added to a stack of bills. When the stack has reached such an extent that the storage means is full, the storage container can be removed and emptied.

If the bill is determined not to be valid it may be passed to the further aperture 12 rather than the storage container and the monetary value is not allocated.

Figures 2A, 2B, 2C:
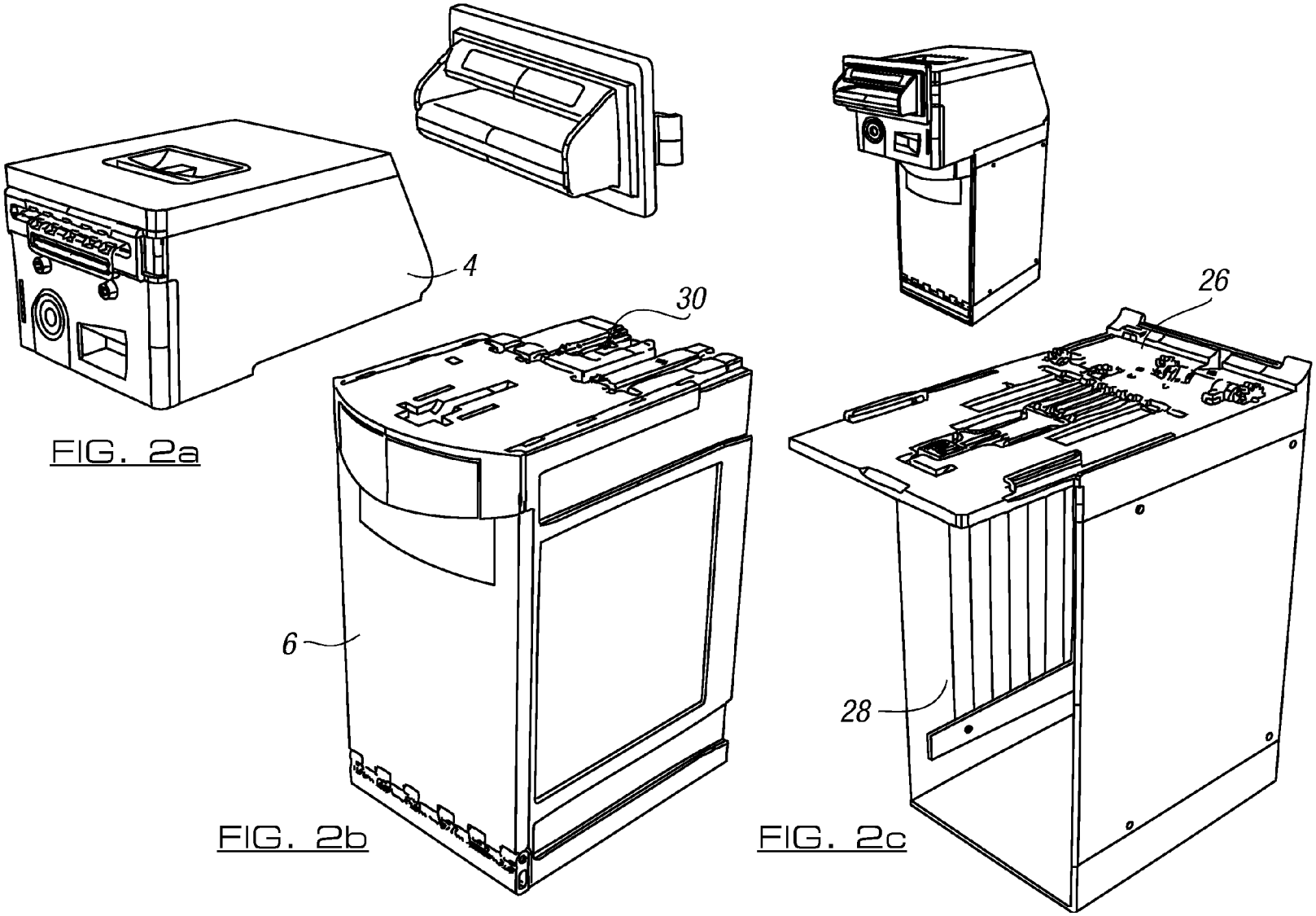
FIGS. 2*a-c* illustrate the infeed assembly separated from the storage container.

FIGS. 2*a-c* illustrate the infeed assembly 4 separated from the storage container 6. The infeed assembly in this embodiment is slidingly locatable. The top surfaces, 26, 30 of the storage container 6 and housing therefore 28 are provided with components which allows the operation of a stacker assembly within the storage container and also the detection of certain conditions of the same.

Figures 3A, 3B:
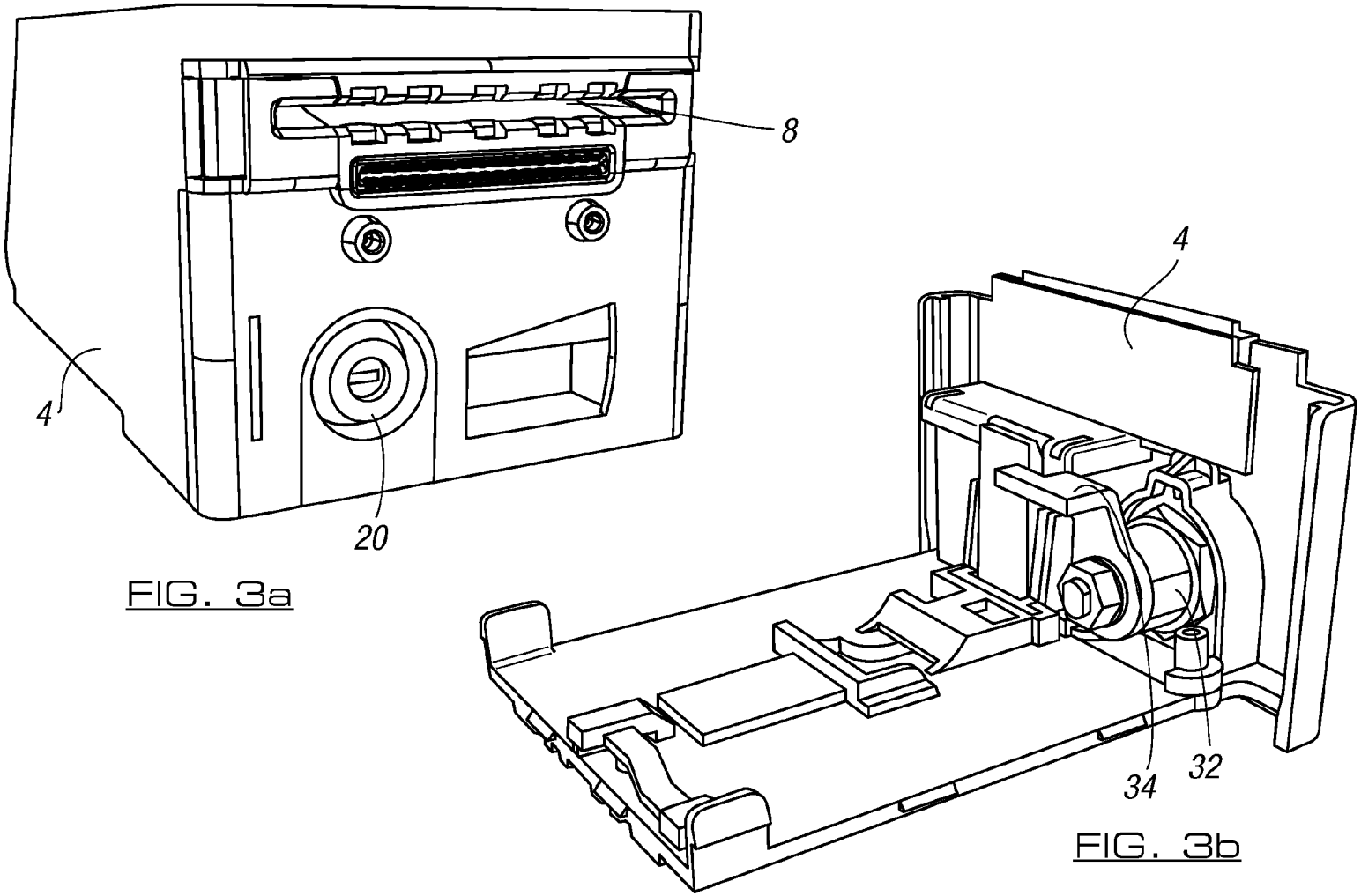
FIGS. 3*a* and *b* illustrate the housing of the infeed assembly.

The separation and location of the infeed assembly 4, housing 28 and container 6 can be achieved via the locking mechanism 20 provided on the outer frame of the infeed assembly 4 as shown in more detail in FIGS. 3*a* and *b*. The locking mechanism includes a barrel 32 connected to arm 34 which is rotatable by rotation of the barrel between a locked position and an unlocked position.

Figures 4A, 4B:
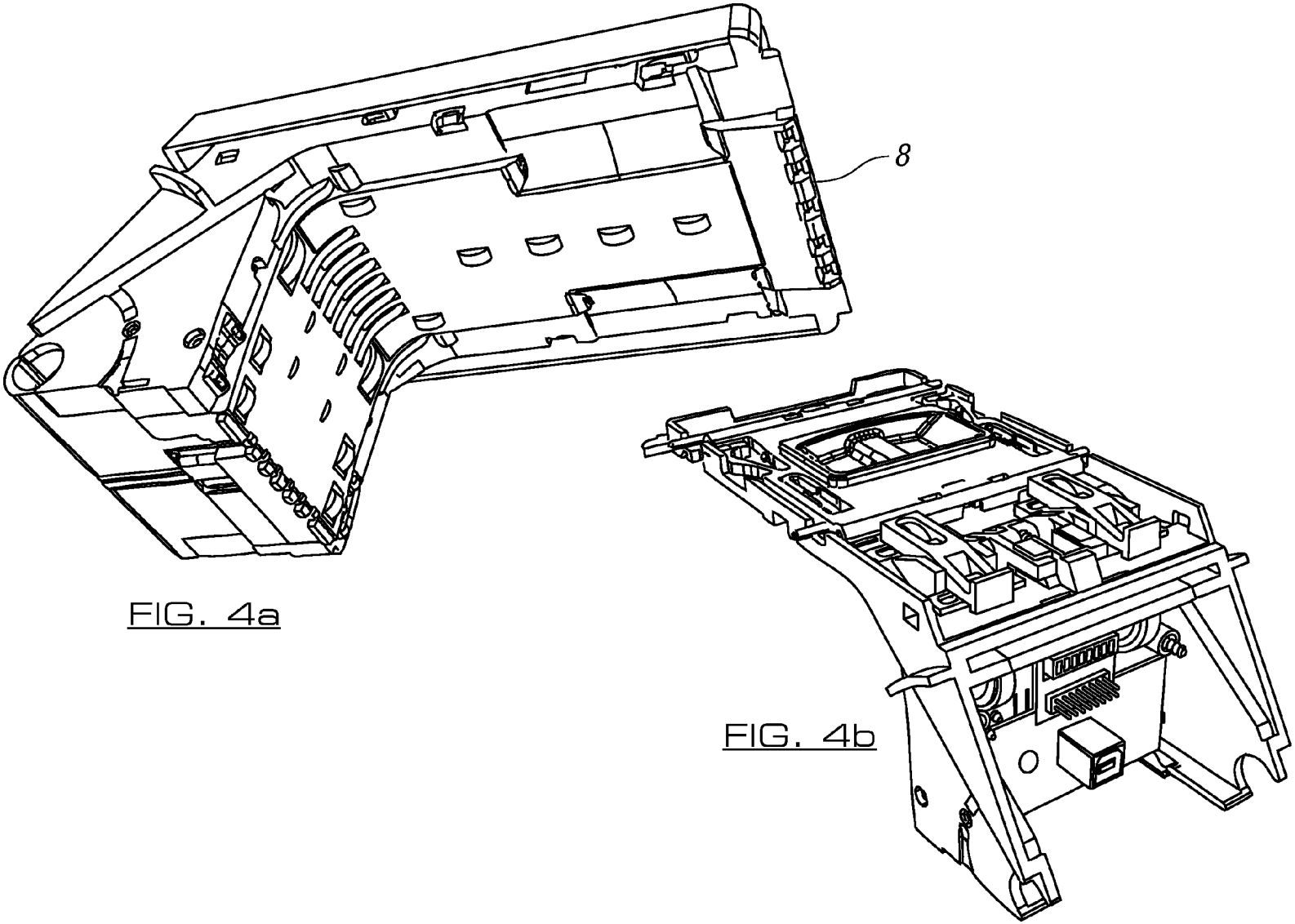
FIGS. 4*a-b* illustrate aspects of the infeed mechanism.

The feeding of the bill through the apparatus is achieved by an infeed mechanism, components of which are shown in FIGS. 4*a-b*. When the bill is introduced into the aperture 8 the same is detected and a cycle of movement commences. This cycle of movement includes in the first stage the operation of arms (not shown) which lie to either longitudinal edge of the bill respectively. These arms are each spring loaded so as to be biased towards a longitudinal note edge and are moved in by the rotational movement of a cam mechanism driven by a motor. These arms, during this stage essentially grip the bill via the edges and as they do so encourage a sliding sideways movement of the bill, as required, in order to move the bill such that the longitudinal centre axis of the bill lies substantially parallel and in line with the longitudinal axis of the movement of the bill along the infeed mechanism. This ensures that the bill is in the required position for accurate identification of the characteristics of the bill and the smooth movement of the bill through the apparatus. As the cam moves, so the first stage of movement changes to the second stage which is the movement of the bill through the infeed assembly to, if the bill is valid, the storage container.

As the change from the first to the second stage occurs, the series of wheels which cause the movement of the bill are moved into contact along the longitudinal axis of the bill. With the wheels in contact with the bill, so the arms are removed from contact with the bill and so it will be appreciated that the bill is always in positive controlled contact with the infeed mechanism.

Figure 6A:
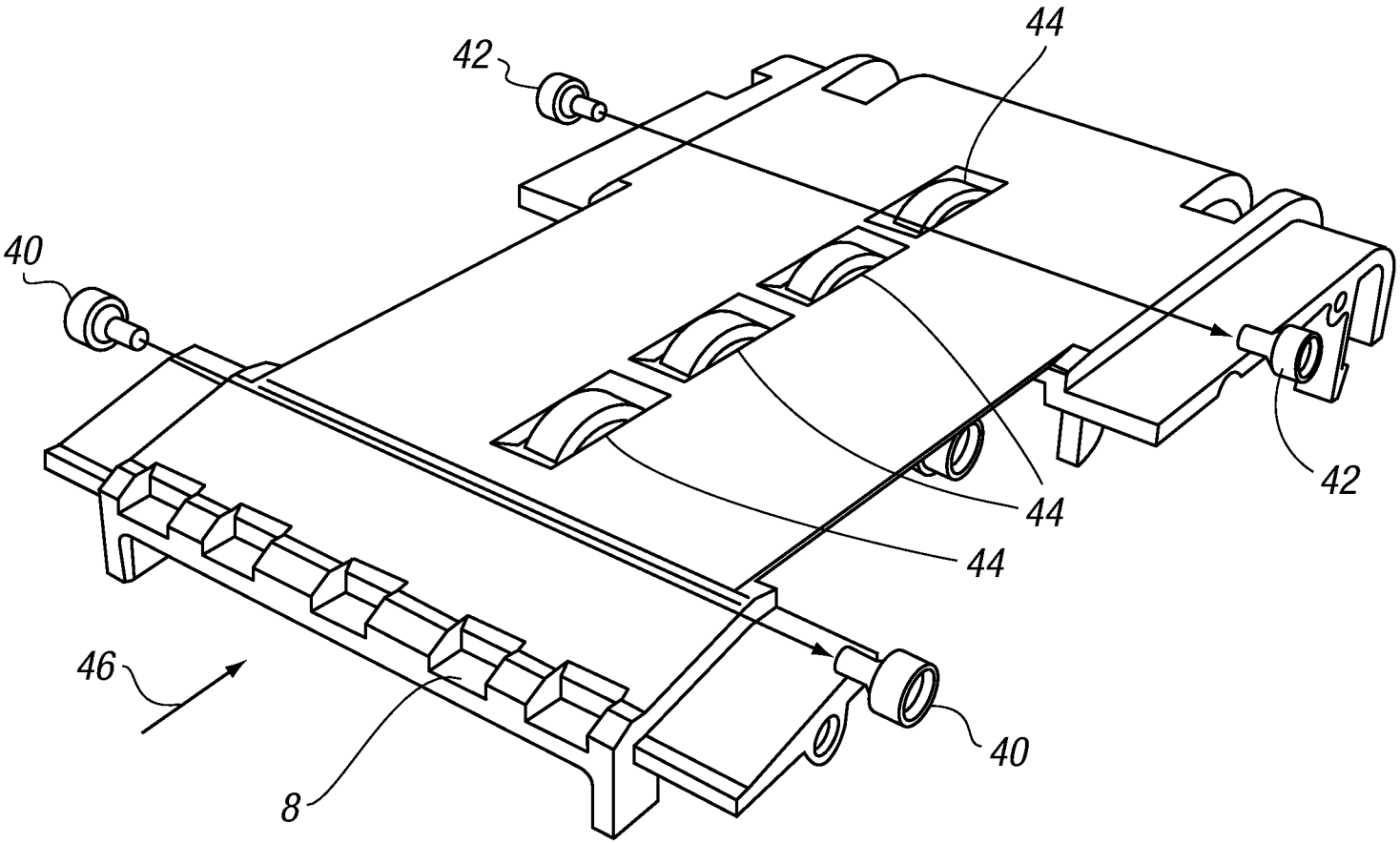
FIGS. 6*a-e* illustrate sensor means used in accordance with one embodiment of the invention.

FIGS. 6*a* and *b* illustrate the provision of sensor arrangements which are used in conjunction with the infeed mechanism. FIG. 6*a* illustrates first and second sets of light sensors 40, 42, each comprising a transmitter and receiver a spaced distance apart across the path of movement of the bill which is achieved via wheels 44. The first sensor set 40 is provided to detect the input of the bill via the aperture 8 in the direction of arrow 46 and the second sensor set 42 is used to detect a stop position for the bill. It should also be noted that one or both sets of the sensors can be used to detect strimming tapes or wires or devices which may be attached to the bill in an attempt to be able to remove the same from the mechanism.

Figure 6B:
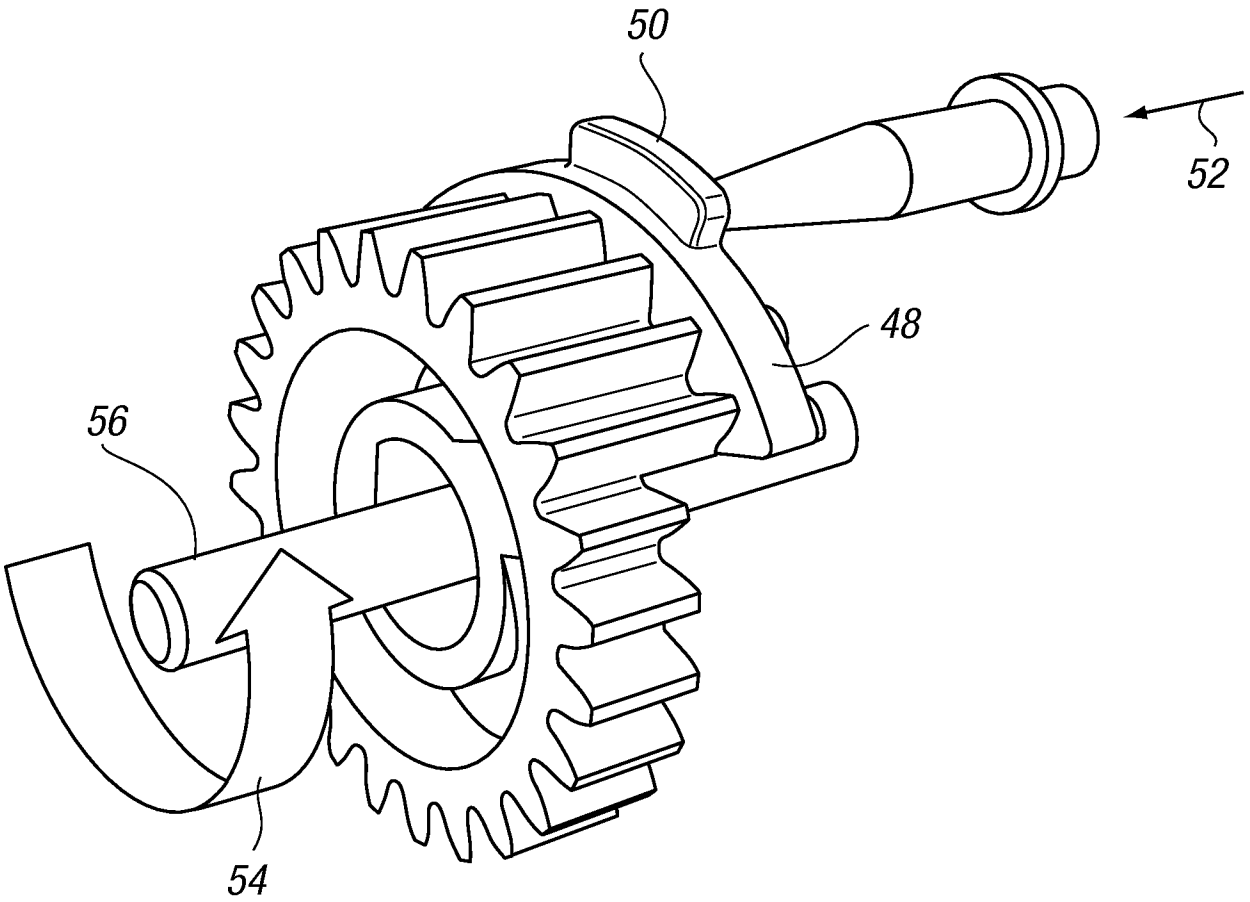

The sensor system of FIG. 6*b* is used to detect that the motor cam 48 used to cause movement of the arms to straighten the bill position is in the correct start position. This is done by providing a tab 50 with a reflective material facing a reflective sensing transmitter and receiver 52. The tab 50 is extended to account for processing delay and motor overrun. The length of this tab can be extended, reduced or the tab moved according to electronic and software requirements. Typically the rotation of the cam is as indicated by arrow 54 via drive of a motor connected to the shaft 56 for the purposes of the arms movement. Operation of the motor in the reverse direction allows for operation of the stacker mechanism assembly as will be described subsequently.

Figure 5A:
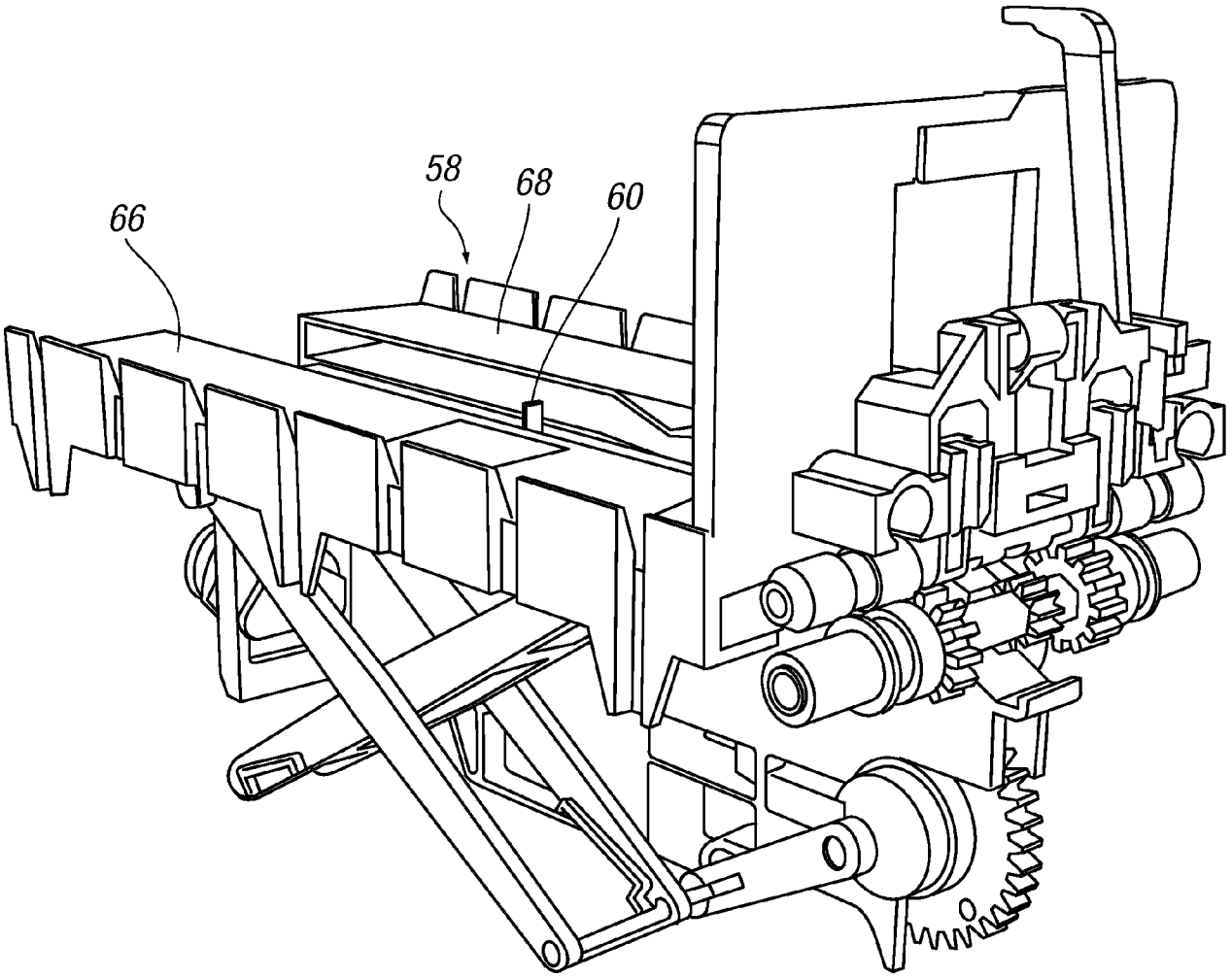
FIGS. 5*a-b* illustrate the stacker assembly for the storage container in accordance with one embodiment of the invention.
Figure 5B:
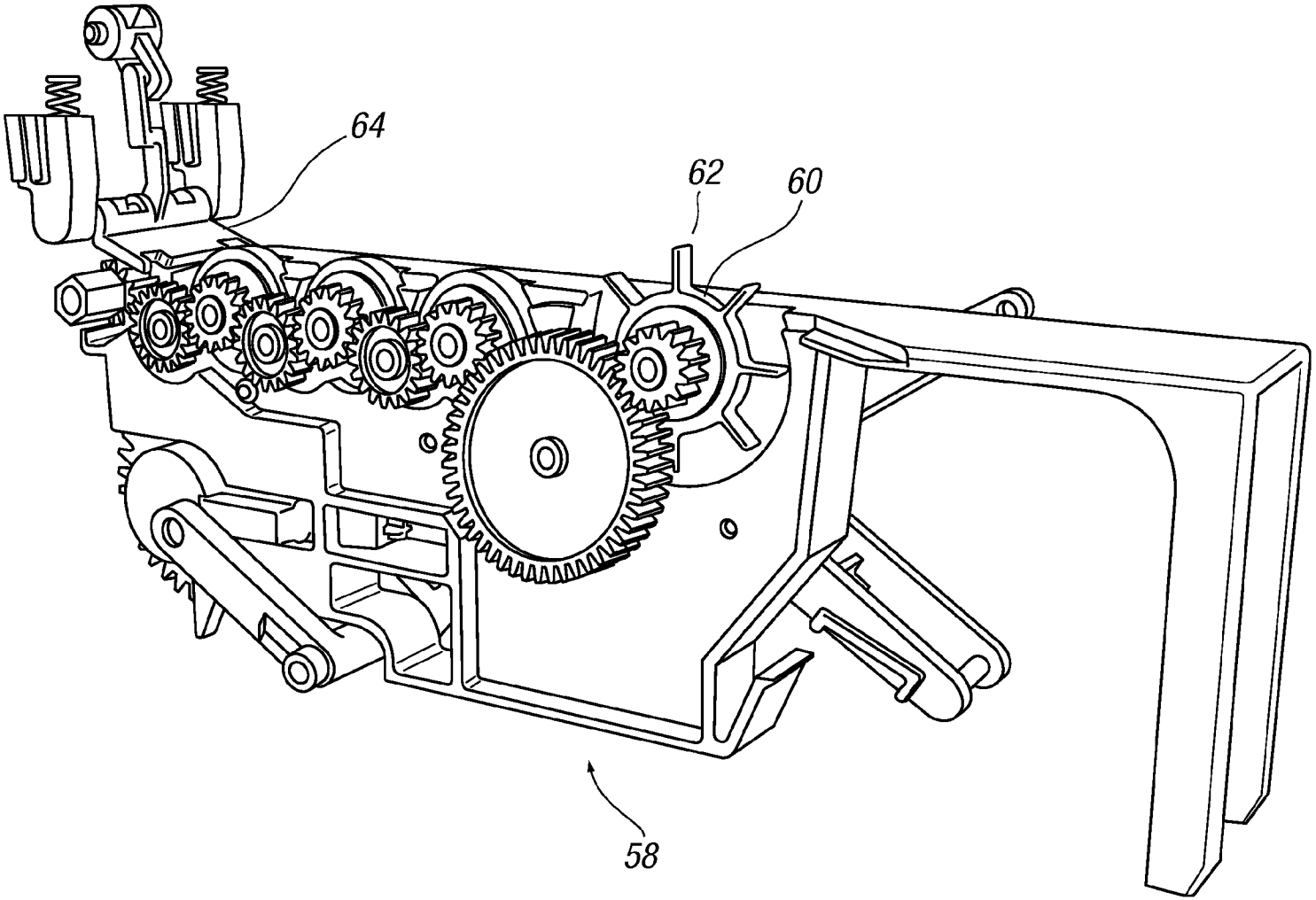

The bill is therefore fed into the storage container from the infeed assembly via a drive path and once entered into the storage container is required to be stacked in an efficient manner with other bills so as to provide effective use of the storage space available. This is achieved by using a stacker mechanism of the type shown in FIG. 5*a* and sectionally in FIG. 5*b*. The stacker assembly 58 includes a wheel 60 with fingers 62 which is driven to pull the bill from entry flap 64 into the required position.

When the bill is determined as being in the correct position in the stacker mechanism two plates 66, 68, one on each side of the bill and overlying the periphery of the bill from each edge, are driven to be moved from a plane to one side of a first planer face of the bill to a plane to the side of the opposing planer face of the bill. This movement causes the bill to contact with the exposed face of the stack of bills and thereafter be added to the stack of bills in an efficient manner. In accordance with this embodiment the movement of the wheel, and plates 66, 68 can be achieved by connection with the motor and, advantageously by movement of the motor in only one rotation direction 96 opposing the direction of arrow 54. This allows the movement in direction of arrow 54 to be possible and to be usable to move the straightening arms.

Also the movement force required using the stacker mechanism in accordance with the invention is less than that required for convention mechanisms and so the work required to be preformed by the motor is reduced.

Figure 6C:
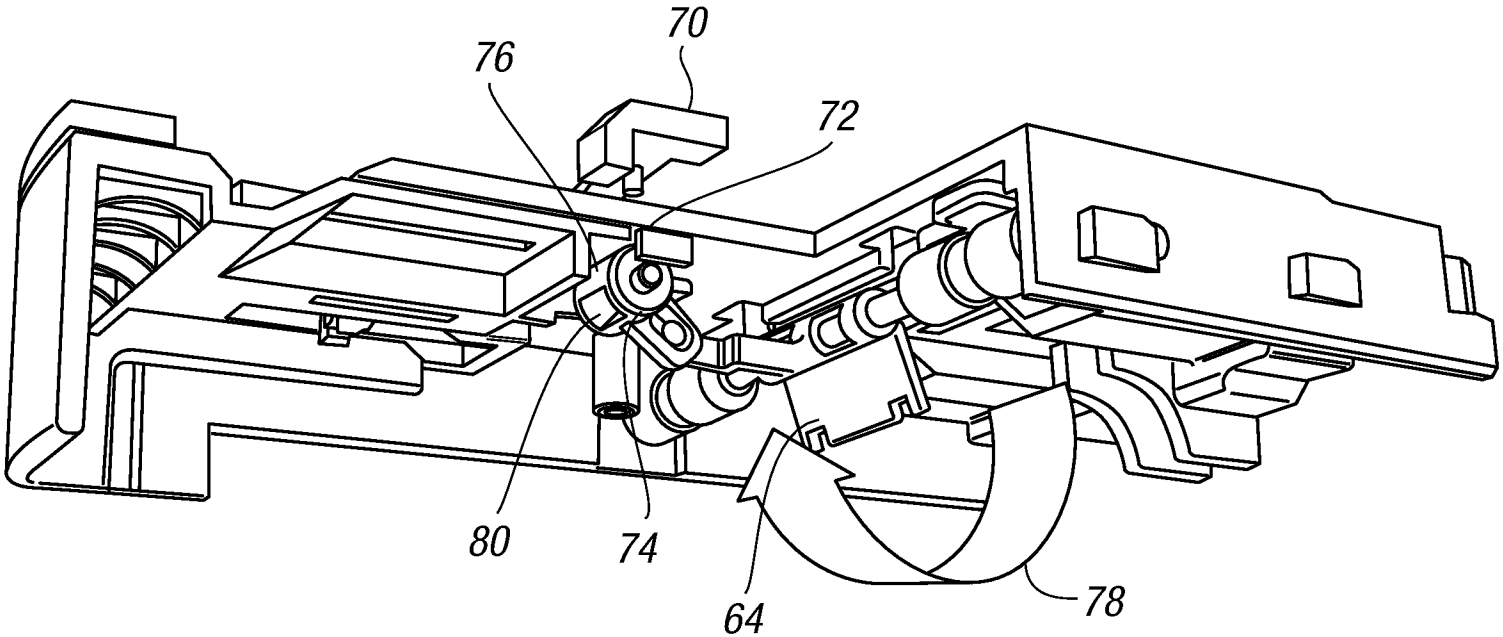

FIG. 6*c* illustrates a sensing assembly which can be used to detect the correct positioning of the bill in relation to the stacker mechanism. The sensor itself is not shown but is located in the infeed assembly housing and is connected to the stacker mechanism via light pipe 70 which is also located in the infeed assembly housing but passes to the sensing aperture 72 on the storage container housing. It should be noted that the light pipes are located in the validator assembly and not in the cashbox housing. The sensing aperture 72 leads to a rotating cylinder 74 on a portion of which is provided a reflective material 76 which is presented to the sensing aperture 72 when it is in a rest position. The cylinder is connected to the flap 64 as shown such that the movement of the flap 64 when the note is introduced from the infeed mechanism in direction 78 causes flap 64 to rotate in that direction and for a through hole 80 on the cylinder to be moved to the sensing aperture 72 and hence causes a change in detection condition to be achieved.

Figure 6D:
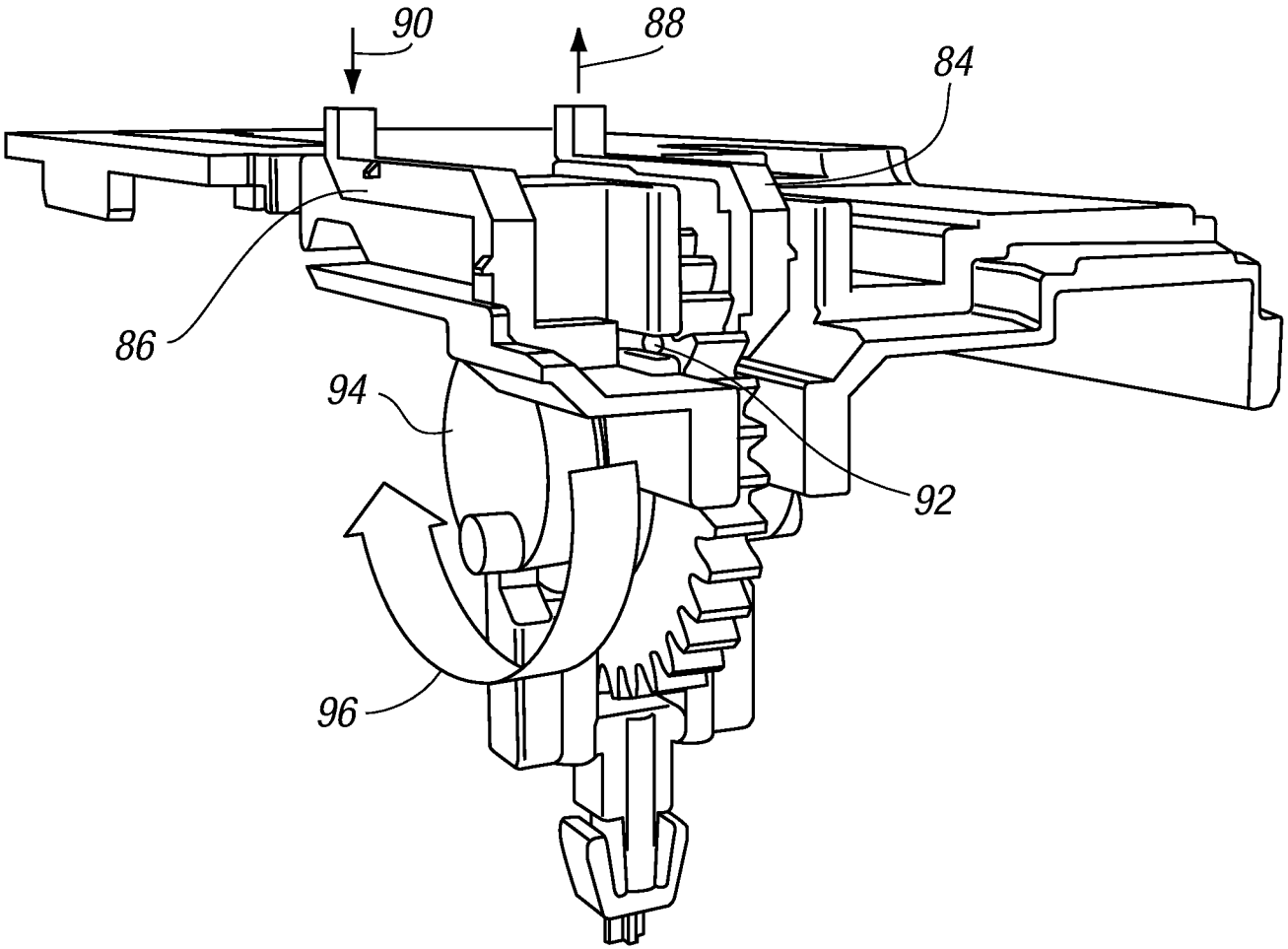

FIG. 6*d* illustrates the sensor system for detection of the position of the stacker mechanism with respect to the storage container. Once again light pipes 84, 86 located in the infeed assembly housing are provided to allow receiving and transmitting light paths 88, 90 to be created respectively. It should be noted that the light pipes are located in the chassis assembly and NOT in the cashbox housing. These paths lead to a through hole 92 in the crank gear connected to the driven cam 94 which controls the movement of the plates 66,68, with the motor moving in the direction 96. It will be appreciated that the through hole can be extended, reduced or moved according to electronic and software requirements (although it must be timed to mechanical ratchet). One rotation of the cam completes a full cycle of movement of the stacker assembly.

It should be appreciated that the size of respective through holes or tabs can be selected to be of a particular length or width to suit particular operation parameters of the apparatus.

Figure 6E:
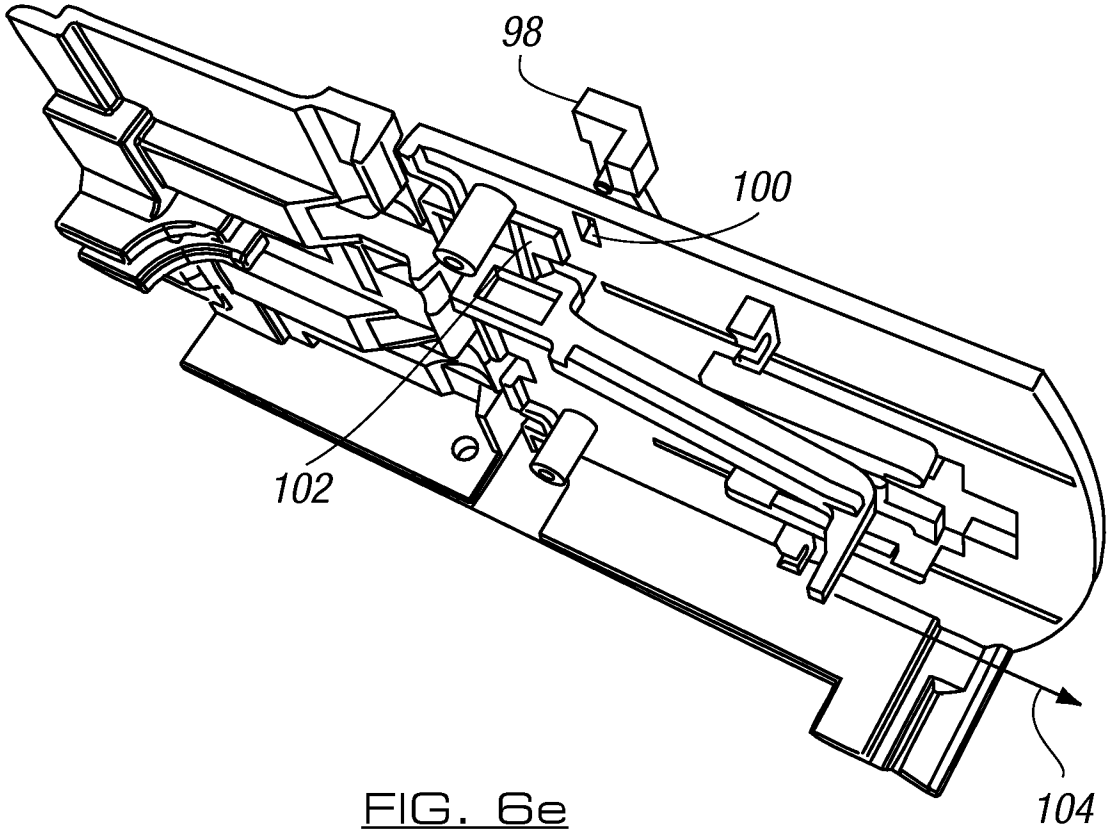

FIG. 6*e* illustrates a further sensor arrangement which uses a single transmitting and receiving light pipe 98, (located only in the validator assembly) passing to a sensing aperture 100. Positioned to the other side of the aperture is a reflective tab, 102 which is moved in the direction of arrow 104 as the size of the stack increases. When the stack is such that the storage container is full the reflective tab is positioned in line with the sensing aperture so as to trigger the container full signal via the light pipe 98.

There is therefore provided in accordance with the invention a number of different aspects which, alone or in combination can be used to improve the provision of bill validation apparatus and the provision of storage containers for the stacked bills.

The invention claimed is:

1. Bill validation apparatus including at least one bill infeed assembly including an infeed aperture, a further aperture located at a rear face of the infeed assembly, a bill infeed mechanism, and a storage container into which accepted bills can be passed for storage from the infeed mechanism, wherein said further aperture is located downstream from the infeed aperture with respect to the passage of the bill from the infeed aperture to the storage container, wherein said further aperture allows the input or exit of bills therethrough at a location on the infeed mechanism before reaching the storage container; and wherein said infeed mechanism is reversible to allow the input of bills through the further aperture and the output of bills to be fed out of the apparatus through the infeed aperture; and wherein said infeed assembly includes first and second sets of light sensors, each set of light sensors comprising a transmitter and receiver a spaced distance apart across the path of movement of the bill, said first set of light sensors positioned at or adjacent the infeed aperture, and said second set of light sensors located downstream from the first set of light sensors, wherein said second set of sensors detect a stop position for the bill intermediate the infeed aperture and the further apertures.

2. Apparatus according to claim 1 wherein a locking mechanism is located so as to prevent the storage container from being separated from the infeed assembly by unauthorised personnel.

3. Apparatus according to claim 2 wherein the locking mechanism is located to prevent the storage container from being removed from a housing to which the storage container and infeed assembly are mounted.

4. Apparatus according to claim 1 wherein the storage container is provided with a locking means which, when locked, serves to prevent access being gained to the interior of the storage container and any bills held therein.

5. Apparatus according to claim 4 wherein a key or access code is common to both the locking mechanism and locking means.

6. Apparatus according to claim 4 wherein different keys or access codes are provided for the locking mechanism and locking means.

7. Bill validation and/or storage apparatus according to claim 1, wherein said bill infeed mechanism includes at least one arm, said arm mounted to be movable in a defined manner, and a plurality of wheels to provide driven movement of the bill through the mechanism, said arm and wheels movable into and out of contact with the bill in a defined manner to provide a straightening action on the bill.

8. Apparatus according to claim 7 wherein the straightening action is performed at or adjacent to the location at which the bill initially enters the apparatus.

9. Apparatus according to claim 7 wherein two arms are provided, said arms provided to act on opposing longitudinal edges of the bill.

10. Apparatus according to claim 9 wherein when the input of the bill is detected, the arms introduced to contact the said edges of the bill exert a straightening action so as to cause the longitudinal axis of the bill to lie substantially parallel with the axis of the path along which the bill is to be moved by the infeed mechanism.

11. Apparatus according to claim 10 wherein the drive wheels follow the arms into contact with the bill to exert the movement force on the same.

12. Apparatus according to claim 11 wherein the wheels are moved into contact with the bill, prior to the arms being moved out of contact from the bill.

13. Apparatus according to claim 7 wherein the movement of the arms and/or wheels with respect to the bill is controlled by a cam movement means which causes the advance and retraction of the arms and/or wheels.

14. Apparatus according to claim 13 wherein the drive which moves the cam is derived from the same motor which is used to operate a bill stacker mechanism within the storage container to which the infeed assembly is attached.

15. Apparatus according to claim 1 wherein the bills are in the form of tickets which have a value allocated to them.

16. Apparatus according to claim 15 wherein the value is allocated in response to a control signal from processing means connected to the apparatus.

17. Apparatus according to claim 16 wherein the value is printed on the ticket via a printer provided as part of the apparatus prior to the ticket being moved into the infeed mechanism.

18. Apparatus according to claim 17 wherein the ticket passes through a validation stage prior to reaching the infeed aperture.

19. Apparatus according to claim 1 wherein the further aperture is provided in connection with a supply of bills which, in response to a specific signal received, can be paid out by passing the same from the further aperture to the infeed aperture.

20. Bill validation and/or storage apparatus according to claim 1 wherein said apparatus includes a lid which can be selectively opened to allow access and closed to allow the apparatus to act as a self contained unit wherein said lid is provided with resilient means which bias the lid to an open position unless the lid is correctly latched in the closed position.

21. Apparatus according to claim 20 wherein the lid is provided with a self latching mechanism such that when the lid is brought to a closed location the self latching mechanism engages and secures the lid in position.

22. Apparatus according to claim 1 wherein the first and second sets of sensors are used to determine respectively the start and stop points for the movement of the bill.

23. Apparatus according to claim 1 wherein there is provided a sensor which allows the determination of the position of the cam for the control of the bill straightening mechanism to be checked to ensure that the same is in the correct position for the next bill.

24. Apparatus according to claim 1 wherein a sensor is provided to allow the detection of the correct location of the bill storage container to be made.

25. Apparatus according to claim 1 wherein a sensor is provided to allow the detection of the position of the stacker mechanism within the storage container to be detected.

26. Apparatus according to claim 1 wherein a sensor is provided to allow a detection to be made of when the storage container is full of bills.

27. Apparatus according to claim 1 wherein the apparatus includes a data storage device reader thereby allowing an operator of the apparatus to update or change operating software or operating parameters by the introduction of, or replacing, a data storage means, into the data storage device reader.

28. Apparatus according to claim 1 wherein the apparatus includes a stacker assembly in which bills are stacked prior to entering the storage container, said stacker mechanism including first and second plates, one on each side of the bill and wherein the plates are moved to bring the bill into contact with an exposed face of the stack of bills.

29. Bill validation apparatus including at least one bill infeed assembly including an infeed aperture, a further aperture located at a rear face of the infeed assembly, a bill infeed mechanism, and a storage container into which accepted bills can be passed for storage from the infeed mechanism, wherein said further aperture is located downstream from the infeed aperture with respect to the passage of the bill from the infeed aperture to the storage container, wherein said further aperture allows the input or exit of bills therethrough at a location on the infeed mechanism before reaching the storage container; and wherein said infeed mechanism is reversible to allow the input of bills through the further aperture and the output of bills through the infeed aperture; and wherein said infeed assembly is slidably removable from said storage container, said bill infeed mechanism including a motor with a cam, arms moved by the cam to straighten the bill position, and a sensor system to detect that the cam is in the correct start position.

30. Bill validation apparatus including at least one bill infeed assembly including an infeed aperture, a further aperture located at a rear face of the infeed assembly, a bill infeed mechanism, and a storage container into which accepted bills can be passed for storage from the infeed mechanism, wherein said further aperture is located downstream from the infeed aperture with respect to the passage of the bill from the infeed aperture to the storage container, wherein said further aperture allows the input or exit of bills therethrough at a location on the infeed mechanism before reaching the storage container; and wherein said infeed mechanism is reversible to allow the input of bills through the further aperture and the output of bills through the infeed aperture; and wherein said infeed assembly is slidably removable from said storage container, said apparatus further including a stacker assembly in which bills are stacked prior to entering the storage container, said stacker mechanism including first and second plates, one on each side of the bill, wherein the plates are moved to bring the bill onto contact with an exposed face of the stack of bills and wherein sensing means are provided to detect the correct position of the bill in relation to the stacker mechanism.

31. Bill validation apparatus including at least one bill infeed assembly including an infeed aperture, a further aperture located at a rear face of the infeed assembly, a bill infeed mechanism, and a storage container into which accepted bills can be passed for storage from the infeed mechanism, wherein said further aperture is located downstream from the infeed aperture with respect to the passage of the bill from the infeed aperture to the storage container, wherein said further aperture allows the input or exit of bills therethrough at a location on the infeed mechanism before reaching the storage container; and wherein said infeed mechanism is reversible to allow the input of bills through the further aperture and the output of bills through the infeed aperture; and wherein said infeed assembly is slidably removable from said storage container, said apparatus further including a plurality of sets of light sensors, each set comprising a transmitter and receiver a spaced distance apart across the path of movement of the bill, with a first sensor set provided to detect the input of the bill via the infeed aperture and a second sensor set provided to detect a stop position for the bill intermediate the infeed aperture and the further aperture, a motor cam and arms moved by the motor cam to straighten the bill position and a sensor system to detect that the motor cam is in the correct start position and a stacker assembly in which bills are stacked prior to entering the storage container, said stacker mechanism including first and second plates, one on each side of the bill, which are moved to bring the bill onto contact with the exposed face of a stack of bills in the stacker assembly and wherein sensing means are provided to detect the correct position of the bill in relation to the stacker mechanism.

* * * * *